US009453385B2

(12) United States Patent
Rytlewski et al.

(10) Patent No.: US 9,453,385 B2
(45) Date of Patent: Sep. 27, 2016

(54) IN-RISER HYDRAULIC POWER RECHARGING

(71) Applicant: Schlumberger Technology Corporation, Sugar Land, TX (US)

(72) Inventors: Gary Rytlewski, League City, TX (US); Kirk Wallace Flight, Spring, TX (US); John Yarnold, League City, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 721 days.

(21) Appl. No.: 13/724,372

(22) Filed: Dec. 21, 2012

(65) Prior Publication Data

US 2013/0175045 A1 Jul. 11, 2013

Related U.S. Application Data

(60) Provisional application No. 61/583,634, filed on Jan. 6, 2012.

(51) Int. Cl.

| | |
|---|---|
| ***E21B 33/035*** | (2006.01) |
| ***E21B 33/064*** | (2006.01) |
| ***E21B 34/04*** | (2006.01) |
| ***F15B 1/02*** | (2006.01) |

(52) U.S. Cl.

CPC ..... *E21B 33/0355* (2013.01); *E21B 34/045* (2013.01); *F15B 1/02* (2013.01); *F15B 2211/212* (2013.01); *F15B 2211/214* (2013.01)

(58) Field of Classification Search

CPC ..... E21B 33/0355; E21B 33/064; E21B 34/045; F15B 1/02; F15B 1/027; F15B 3/00

USPC ..... 166/363, 336, 368

See application file for complete search history.

(56) References Cited

U.S. PATENT DOCUMENTS

| | | | | |
|---|---|---|---|---|
| 3,743,013 | A * | 7/1973 | Harbonn | F15B 1/02 166/368 |
| 4,955,195 | A * | 9/1990 | Jones | E21B 34/16 137/1 |
| 5,101,907 | A * | 4/1992 | Schultz | E21B 23/04 166/319 |
| 5,127,477 | A * | 7/1992 | Schultz | E21B 34/16 166/324 |
| 6,293,344 | B1 | 9/2001 | Nixon et al. | |
| 7,107,766 | B2 * | 9/2006 | Zacche' | A23L 3/0155 60/413 |
| 7,665,527 | B2 * | 2/2010 | Loretz | E21B 23/04 166/319 |
| 7,891,429 | B2 | 2/2011 | Boyce et al. | |
| 7,921,919 | B2 * | 4/2011 | Horton, III | E21B 43/017 166/350 |
| 8,220,773 | B2 * | 7/2012 | Gustafson | E21B 33/0355 166/364 |
| 8,453,762 | B2 * | 6/2013 | Law | E21B 19/086 137/14 |

(Continued)

OTHER PUBLICATIONS

International Search Report and Written Opinion completed on Apr. 22, 2013 for International Patent Application No. PCT/US2013/020089, filed on Jan. 3, 2013, 11 pages.

*Primary Examiner* — Matthew R Buck

(74) *Attorney, Agent, or Firm* — Tuesday Kaasch

(57) ABSTRACT

A method for pressurizing a hydraulic accumulator includes creating an annulus pressure zone in hydraulic communication with the hydraulic accumulator through a hydraulic recharging circuit and applying a hydraulic pressure to the annulus pressure zone. Operating the hydraulic recharging circuit in response to applying the hydraulic pressure and pressurizing the hydraulic accumulator in response to operating the hydraulic recharging circuit.

7 Claims, 8 Drawing Sheets

(56) References Cited

U.S. PATENT DOCUMENTS 8,925,635 B2 * 1/2015 Yamahata ..... E21B 34/045 166/338
8,931,577 B2 * 1/2015 Arteaga ..... E21B 33/062 137/102
2007/0000667 A1 1/2007 Mackenzie et al.
2007/0120722 A1 5/2007 Nygard et al.
2011/0005770 A1 1/2011 Scranton et al.
2012/0138159 A1 * 6/2012 Wordley ..... E21B 33/0355 137/15.01
2012/0279720 A1 * 11/2012 Whitby ..... E21B 33/0355 166/363

* cited by examiner

IN-RISER HYDRAULIC POWER RECHARGING

RELATED APPLICATIONS

This application claims the benefit of U.S. provisional application No. 61/583,634 filed on Jan. 6, 2012.

BACKGROUND

This section provides background information to facilitate a better understanding of the various aspects of the disclosure. It is to be understood that the statements in this section of this document are to be read in this light, and not as admissions of prior art.

Offshore systems (e.g., lakes, bays, seas, oceans etc.) often include a riser which connects a surface vessel's equipment to a blowout preventer stack on a subsea wellhead. Offshore systems which are employed for well testing operations also typically include a safety shut-in system which automatically prevents fluid communication between the well and the surface vessel in the event of an emergency. Typically, the safety shut-in system includes a subsea test tree which is landed inside the blowout preventer stack on a pipe string. The subsea test tree generally includes a valve portion which has one or more safety valves that can automatically shut-in the well via a subsea safety shut-in system. Hydraulic and electrical power to actuate the valves and devices of the subsea test tree is often communicated from the surface vessel by an umbilical.

SUMMARY

In accordance to one or more embodiments, a method for pressurizing a hydraulic accumulator includes creating an annulus pressure zone in hydraulic communication with the hydraulic accumulator through a hydraulic recharging circuit and applying a hydraulic pressure to the annulus pressure zone. The hydraulic recharging circuit is operated in response to applying the hydraulic pressure and the hydraulic accumulator is pressurized in response to operating the hydraulic recharging circuit.

An embodiment of a subsea well system includes a riser extending from a water surface to a blowout preventer stack located at a wellhead at a seafloor, a subsea tree landed in a bore of the blowout preventer stack on a landing string extending through the riser, a hydraulic power unit connected within the landing string, the hydraulic power unit having a closed loop hydraulic control circuit extending from a hydraulic supply accumulator through a hydraulically actuated device to a hydraulic reservoir, and a hydraulic recharging circuit hydraulically connected between the closed loop hydraulic circuit and an annulus pressure zone created in the blowout preventer stack. The hydraulic recharging circuit pressurizes the hydraulic accumulator in response to a hydraulic pressure applied to the annulus pressure zone.

An example of a method for recharging hydraulic power in a subsea well system in accordance to one or more embodiments includes creating an annulus pressure zone in a blowout preventer stack. The subsea well system may include a riser extending from a water surface to the blowout preventer stack located at a wellhead at a seafloor, a subsea tree landed in the blowout preventer stack on a landing string extending through the riser, a hydraulic power unit connected with the landing string and having a closed loop hydraulic control circuit extending from a hydraulic supply accumulator through a hydraulically actuated device to a hydraulic reservoir, and a hydraulic recharging circuit hydraulically connected between the created annulus pressure zone and the closed loop hydraulic control loop. The method includes applying a hydraulic pressure to the annulus pressure zone, operating the hydraulic recharging circuit in response to the applied hydraulic pressure, and pressurizing the hydraulic supply accumulator in response to operating the hydraulic recharging circuit.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

Embodiments of in-riser hydraulic power recharging devices and methods are described with reference to the following figures. The same numbers are used throughout the figures to reference like features and components. It is emphasized that, in accordance with standard practice in the industry, various features are not necessarily drawn to scale. In fact, the dimensions of various features may be arbitrarily increased or reduced for clarity of discussion.

DETAILED DESCRIPTION

Figure 1:
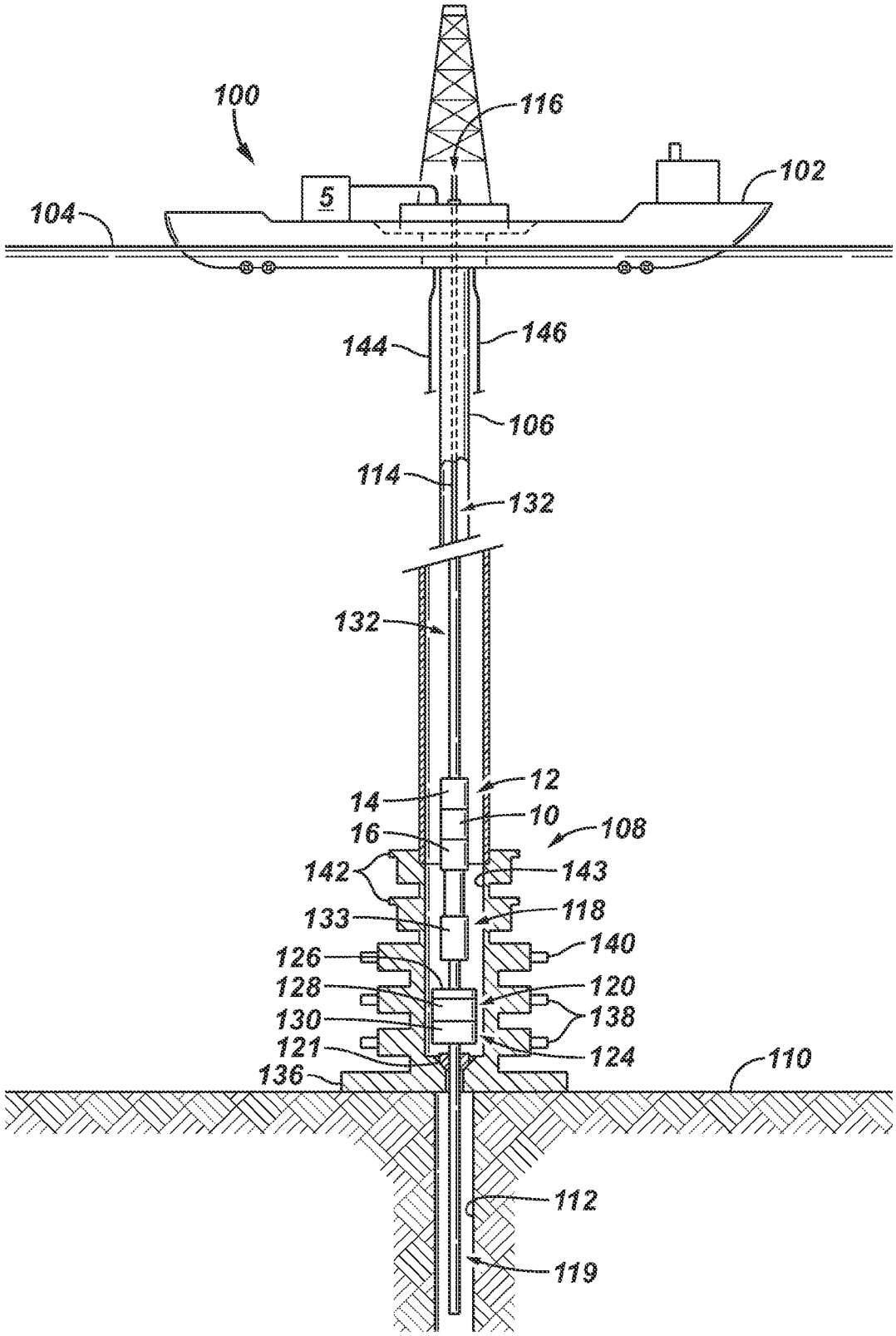
FIG. 1 illustrates an example of a subsea well system in which embodiments of in-riser hydraulic power recharging devices and methods can be implemented.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point as the surface from which drilling operations are initiated as being the top point and the total depth being the lowest point, wherein the well (e.g., wellbore, borehole) is vertical, horizontal or slanted relative to the surface. In this disclosure, "hydraulically coupled," "hydraulically connected," and similar terms, may be used to describe bodies that are connected in such a way that fluid pressure may be transmitted between and among the connected items.

FIG. 1 illustrates an example of a subsea well system 100 in which embodiments of in-riser hydraulic power recharging systems 10 can be implemented. Subsea well system 100 includes a vessel 102 which is positioned on a water surface 104 and a riser 106 which connects vessel 102 to a blowout preventer ("BOP") stack 108 on seafloor 110. A well 112 has been drilled into seafloor 110 and a tubing string 114 extends from vessel 102 through riser 106 and through blowout preventer stack 108 into well 112. Tubing string 114 is provided with a bore 116 through which fluids (e.g., formation fluid, drilling fluid) can be conducted between well 112 and surface 104. Although vessel 102 is illustrated as a ship, vessel 102 may include any platform suitable for wellbore drilling, production, or injection operations.

A subsea tree 120 is landed in blowout preventer stack 108 on the upper portion of tubing string 114, referred to herein as landing string 132. A lower portion 119 of tubing string 114 extends into well 112 and is supported by a tubing hanger 121 that is landed in wellhead 136. Subsea tree 120 includes valve assembly 124 and a latch 126. Valve assembly 124 may act as a master control valve during testing of well 112. Valve assembly 124 may include one or more valves (i.e., hydraulically actuated devices), such as flapper valve 128 and a ball valve 130. Latch 126 allows landing string 132 to be disconnected from subsea tree 120, for example during an emergency shutdown. Retainer valve 133 is arranged at the lower end of landing string 132 to prevent fluid in the upper portion of tubing string 114 from draining into the subsea environment when the landing string is disconnected from subsea tree 120. It should be clear that the embodiments are not limited to the particular embodiment of subsea tree 120 shown, but any other valve system that controls flow of fluids through tubing string 114 may also be used. An example of a subsea tree that may be utilized is disclosed in U.S. Pat. No. 6,293,344.

Blowout preventer stack 108 includes pipe rams 138, shear rams 140, and annular rams 142. BOP stack 108 defines a passage 143 for receiving tubing string 114. Subsea tree 120 is arranged within blowout preventer stack 108, and retainer valve 133 extends from subsea tree 120 into annular rams 142. With additional reference to FIG. 2, external fluid communication with passage 143 of BOP stack 108 is provided through BOP access lines 144, 146, which are illustrated extending along the exterior of riser 106 in FIG. 1. The BOP access lines may be referred to individually as kill and choke lines. Drilling fluid 26 (FIG. 2) can be pumped for example via fluid system 5 into the BOP stack 108 via BOP access line 144, for example, and fluid 26 can be removed from the BOP stack 108 via BOP access line 146, for example.

Subsea well system 100 includes a safety shut-in system 118 which provides automatic shut-in of well 112 when conditions on vessel 102 or in well 112 deviate from preset limits. Safety shut-in system 118 includes subsea tree 120 and a subsea control system 12 to operate various hydraulically actuated devices of subsea tree 120 such as, and without limitation, valves 128, 130, retainer valve 133 and latch 126. Subsea control system 12 can be utilized to operate, for example, valves 128, 130 during well testing or other production or injection operations as well as during emergency shutdown. In the illustrated embodiment, subsea control system 12 is a modular unit that includes a subsea hydraulic power unit 14 (e.g., accumulators, pumps, valves, hydraulic circuits) to operate the hydraulic device actuations of subsea tree 120 control systems, safety valves 128, 130, latch 126, tubing hanger 121, and other downhole valves and control systems. The modular units can be connected within landing string 132 to form a continuous axial bore 116 between vessel 102 and well 112. Hydraulic power unit 14 may comprise a closed loop hydraulic control circuit between pressurized hydraulic accumulators (i.e., supply accumulators), hydraulic reservoirs and the hydraulically actuated devices. A hydraulic accumulator refers to a hydraulic device that is able to store potential energy that when released provides hydraulic activation pressure to enable actuation of a hydraulically operated device. Subsea control system 12 may include electrical system 16 (e.g., batteries, processors, electrical circuits) for example deployed with hydraulic power unit 14.

Techniques and devices disclosed herein may be used in cooperation with existing components and control systems. For example, embodiments of in-riser hydraulic power recharging systems 10 may be employed with the SenTURIAN Deep Water Control System manufactured by Schlumberger Corporation and the SenTURIAN Subsea landing string electrohydraulic operating system. Non-limiting examples of subsea control system 12 and hydraulic power unit 14 are described in U.S. publication 2011/0120722 and U.S. publication 2011/0005770, which are incorporated by reference herein.

Each hydraulic device actuation reduces the available hydraulic supply pressure of subsea hydraulic power unit 14. Embodiments of subsea well system 100 include in-riser hydraulic power recharging system 10 in hydraulic communication with hydraulic power unit 14 to recharge the hydraulic pressure of one or more hydraulic accumulators. Recharging hydraulic power unit 14 includes pressurizing one or more hydraulic accumulators.

According to some embodiments in-riser hydraulic power recharging system 10 is in hydraulic communication with a BOP access line, for example, BOP access line 144, to recharge the hydraulic pressure supply of hydraulic power unit 14. For example, in-riser hydraulic power recharging system may be in hydraulic communication with an annulus pressure zone 18 created in BOP stack 108 (see, e.g., FIGS. 2, 3), for example by closing one or more of the blowout preventer rams 138, 142, from which hydraulic pressure can be harvested for operating in-riser hydraulic power recharging system 10. According to embodiments, hydraulic power unit 14 can be recharged without being connected to an umbilical extending from surface 104 for example or by connection with a remote operated vehicle.

Figure 2:
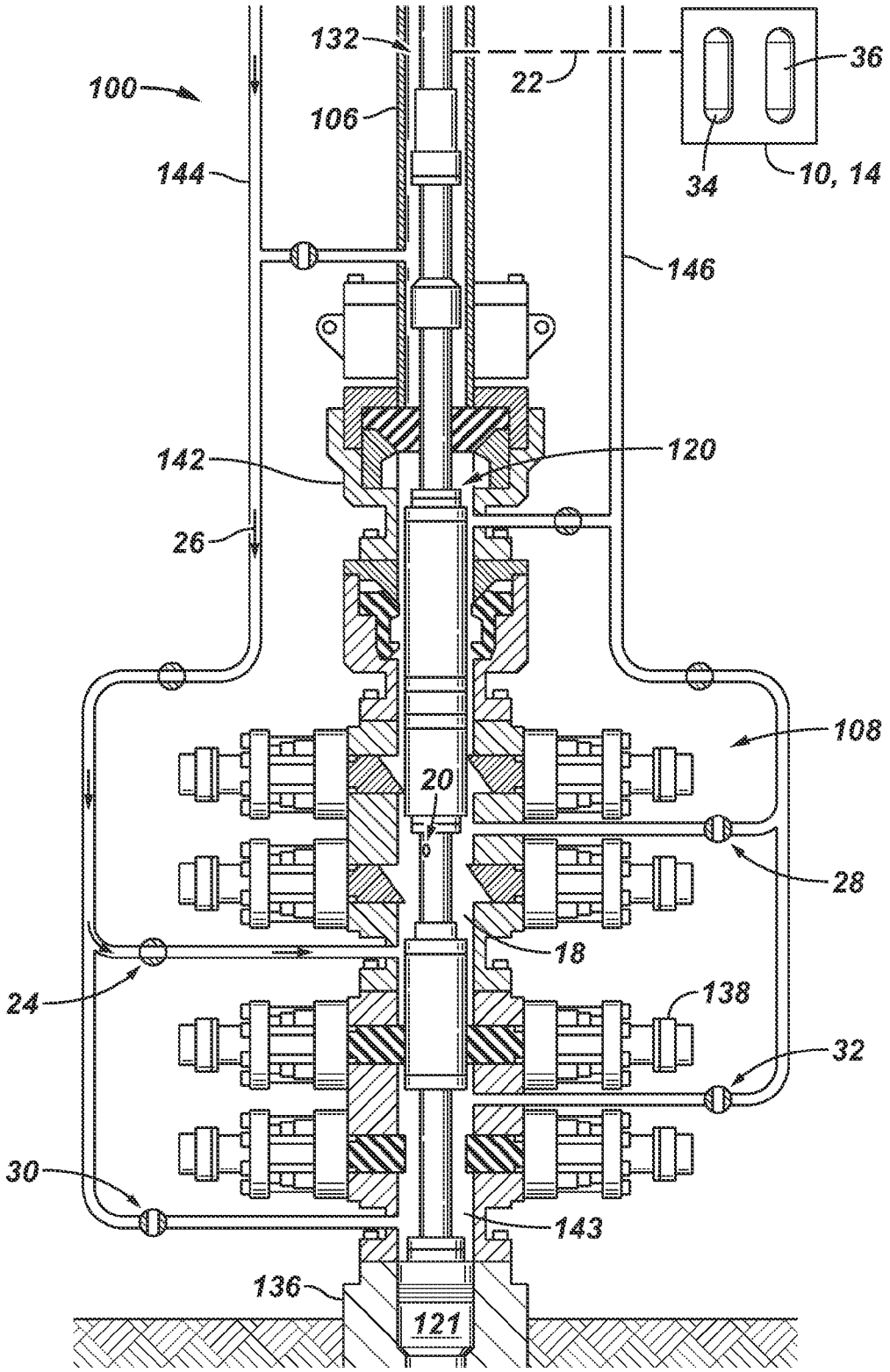
FIG. 2 is a schematic diagram of a subsea well system in accordance with one or more embodiments.

For example, with reference to FIG. 2, a BOP annulus pressure zone 18 is illustrated created in BOP passage 143 between a closed annular ram 142 and a closed pipe ram 138 and between landing string 132 (i.e., subsea tree 120) and BOP stack 108. In-riser hydraulic power recharging system 10 may be in hydraulic communication with BOP annulus pressure zone 18 for example through hydraulic supply port 20 and hydraulic conduit 22. Hydraulic power unit 14 may include for example one or more hydraulic supply accumulators 34 and a hydraulic reservoir 36. Hydraulic reservoir 36 may be spring biased (i.e., pressurized fluid, mechanical spring) to be above hydrostatic pressure if it is desired for the hydraulic reservoir to be positive pressurized. BOP access line 144 may be opened, for example opening valve 24, to communicate fluid 26 (i.e., drilling fluid) from fluid system 5 (FIG. 1) through BOP access line 144 to the created BOP annulus pressure zone 18. Valve 28 in BOP access line 146 is closed allowing hydraulic pressure to build in annulus pressure zone 18 to operate in-riser hydraulic power recharging system 10. Hydraulic pressure in BOP annulus pressure zone 18 can be communicated through port 20 and hydraulic conduit 22 to pressurize at least one hydraulic supply accumulator 34 of hydraulic power unit 14. BOP access line 146 may be opened at valve 28 to relieve the hydraulic supply pressure in annulus pressure zone 18.

Figure 3:
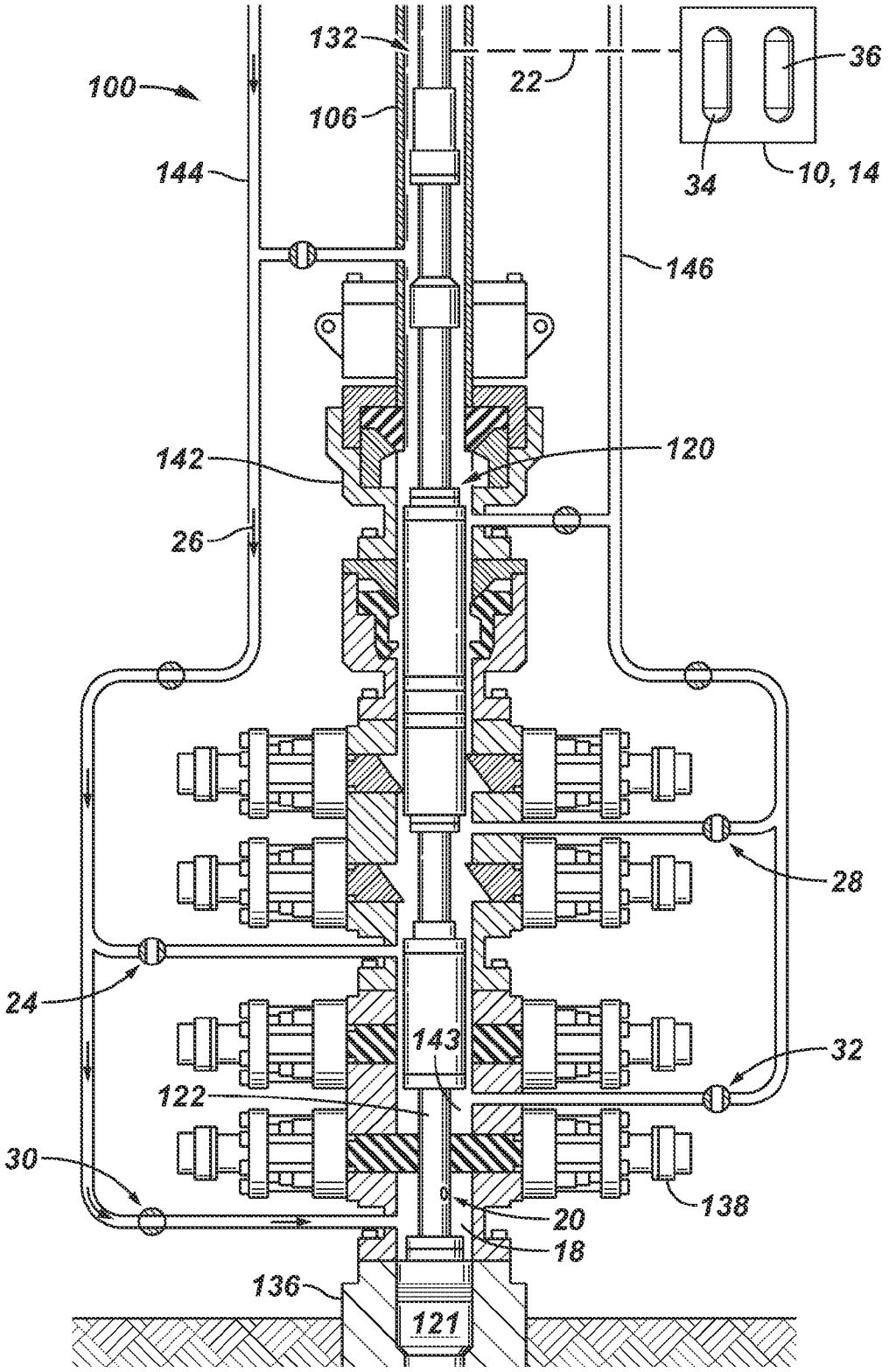
FIG. 3 is a schematic diagram of a subsea well system in accordance with one or more embodiments.

A non-limiting example for harvesting hydraulic pressure to recharge hydraulic power unit 14 is described with reference to FIG. 3. Hydraulic power unit 14 may include for example one or more hydraulic supply accumulators 34 and hydraulic reservoirs 36. Hydraulic pressure may be harvested during pressure testing of the subsea well system 100. For example, with additional reference to FIG. 1, tubing hanger 121 is landed in wellhead 136 on landing string 132. Tubing hanger 121 (i.e., hydraulically actuated device) is set in wellhead 136, for example by operation of control system 12 and utilizing hydraulic power from hydraulic power unit 14. A pipe ram 138 is closed, for example on a slick joint 122 of subsea tree 120, creating closed annulus pressure zone 18. Valve 30 may be opened and fluid 26 from fluid system 5 can be supplied though BOP access line 144 to annulus pressure zone 18 to pressure test the seal of tubing hanger 121. The pressure in closed annulus pressure zone 18 can be communicated through port 20 to in-riser hydraulic power recharging system 10 to recharge the hydraulic power expended for example to set tubing hanger 121. Pressure in annulus pressure zone 18 can be relieved, for example, by opening pipe ram 138 and valve 32 in BOP access line 146 in the depicted embodiment.

Figure 4:
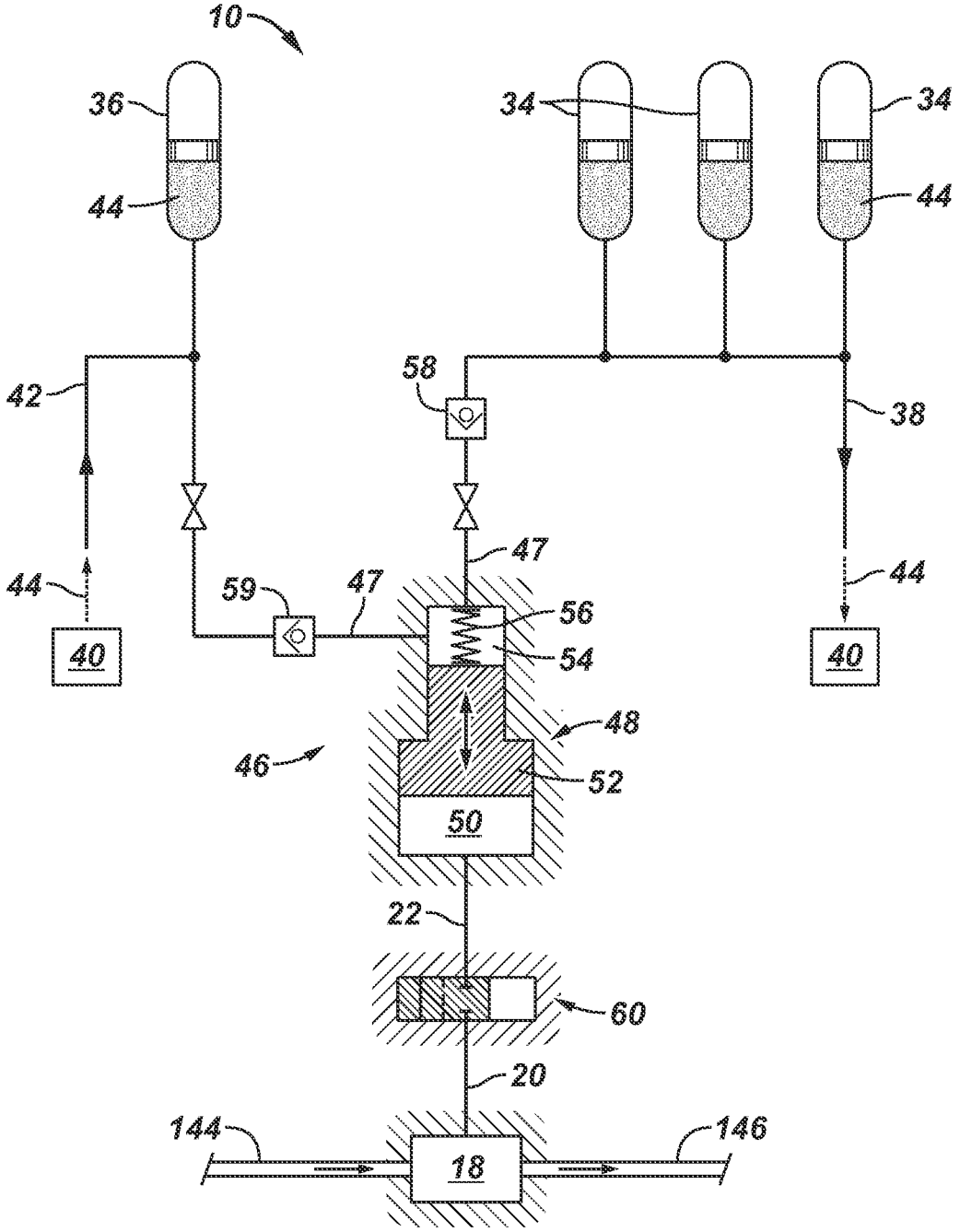
FIG. 4 is a schematic diagram of an example of an in-riser hydraulic power recharging system in accordance to one or more embodiments.

FIG. 4 is a schematic diagram of an example of an in-riser hydraulic power recharging system 10 according to one or more embodiments. With reference also to FIGS. 1-3, in-riser hydraulic power recharging system 10 provides hydraulic communication between the created annulus pressure zone 18 and the closed loop hydraulic control circuit 38, 42 extending from a hydraulic accumulator 34 (i.e., supply accumulators) through a supply conduit 38 to a hydraulically actuated device generally denoted by the numeral 40, and from the hydraulically actuated device 40 through a return conduit 42 to hydraulic reservoir 36. Hydraulically actuated device 40 includes without limitation tubing hanger 121, latch 126, and safety valves 128, 130. For example, to actuate hydraulically actuated device 40 hydraulic pressure and fluid 44 is communicated from a hydraulic supply accumulator 34 through supply conduit 38 to hydraulically actuated device 40. Upon actuation of hydraulically actuated device 40, hydraulic fluid 44 is communicated from hydraulically actuated device 40 through return conduit 42 to hydraulic reservoir 36.

In-riser hydraulic power recharging system 10 includes a hydraulic recharging circuit generally denoted by the numeral 46 in hydraulic communication between annulus pressure zone 18 and closed loop hydraulic control circuit 38, 42. The hydraulic power recharging system 10 illustrated in FIG. 4 may be described as a primary recharging system. According to embodiments, hydraulic recharging circuit 46 includes one or more hydraulic intensifiers 48. For example, with reference to FIG. 4, an intensifier 48 is disposed in hydraulic conduit 22 between annulus pressure zone 18 and closed loop hydraulic control circuit 38, 42. Hydraulic pressure applied at annulus pressure zone 18 is communicated to a low pressure side 50 of intensifier 48 to act on piston 52 and urge piston 52 in a first direction toward high pressure side 54 communicating pressurized hydraulic fluid 44 through supply conduit 38 to hydraulic supply accumulators 34. In the depicted embodiments, low pressure side 50 of piston 52 has a larger surface area than high pressure side 54 of piston 52. Upon release of the hydraulic pressure applied in annulus pressure zone 18, intensifier spring 56 (e.g., mechanical spring, pressurized fluid spring, mechanical switching valve, etc.) urges piston 52 in the second direction toward low pressure side 50 drawing hydraulic fluid 44 from hydraulic reservoir 36 and return conduit 42 to high pressure side 54 of intensifier 48. According to embodiments, high pressure side 54 of intensifier 48 is hydraulically connected to hydraulic supply conduit 38 through a supply control valve 58 (e.g., one-way valve) and similarly high pressure side 54 is hydraulically connected to hydraulic return conduit 42 through a return, or reserve, control valve 59 (e.g., one-way valve). High pressure side 54 can include conduit 47 extending between supply one-way valve 58 and reserve one-way valve 59. According to some embodiments, a valve 60 may be connected between annulus pressure zone 18 and low pressure side 50 of intensifier 48 to control communication of hydraulic pressure in annulus pressure zone 18 and hydraulic recharging circuit 46. The process is repeated until the closed loop hydraulic circuit 38, 42 pressure range is achieved, for example a hydraulic supply accumulator 34 is pressurized to a desired hydraulic pressure level.

An example of a method of operation is now described with reference to FIGS. 1-4. A hydraulically actuated device 40 is operated reducing the hydraulic pressure stored in hydraulic supply accumulators 34. To recharge the pressure of hydraulic supply accumulators 34 an annulus pressure zone 18 is created in BOP stack 108. Annulus pressure zone 18 is created by closing one or more for example by closing one or more of BOP pipe rams 138 and or annular rams 142. A BOP access line, for example BOP access line 144 is opened to communicate with annulus pressure zone 18 and communication with the corresponding BOP access line 146 is closed if necessary. A hydraulic pressure is applied to annulus pressure zone 18, for example, fluid system 5 may be operated to communicate fluid 26 and pressure to annulus pressure zone 18. The hydraulic pressure may be applied to annulus pressure zone 18 solely for the purpose of operating hydraulic pressure recharging circuit 46 and hydraulic power recharging system 10 or the hydraulic power may be applied during testing operations. The increasing applied hydraulic pressure in annulus pressure zone 18 is communicated to intensifier 48. The increasing applied pressure operates intensifier 48 to communicate hydraulic fluid 44 in the supply conduit 38 side of hydraulic control circuit to hydraulic supply accumulator(s) 34 and to draw hydraulic fluid 44 from the return conduit 42 side of hydraulic control circuit 38, 42 into hydraulic recharging circuit 46 and high pressure side 54 of intensifier 48. When the stroke of piston 52 in the direction from low pressure side 50 to high pressure side 54 has stopped, hydraulic pressure in annulus pressure zone 18 is relieved, for example, by opening a BOP access line 146 in communication with annulus pressure zone 18. When the hydraulic pressure is relieved from annulus pressure zone 18, spring 56 urges piston 52 toward low pressure side 50 causing hydraulic fluid 44 to be drawn from return conduit 42 and hydraulic reservoir 36 of hydraulic control circuit 38, 42 into hydraulic recharging circuit 46 at high pressure side 54. The process of building and relieving pressure in annulus pressure zone 18 communicated to recharging circuit 46 can be repeated until the desired hydraulic pressure level is achieved in hydraulic supply accumulator(s) 34. Hydraulic recharging circuit 46 is operated in response to applying a hydraulic pressure to annulus pressure zone 18. In accordance to some embodiments, the applied hydraulic pressure includes increasing or building pressure and decreasing or relieving pressure in annulus pressure zone 18.

Figure 5:
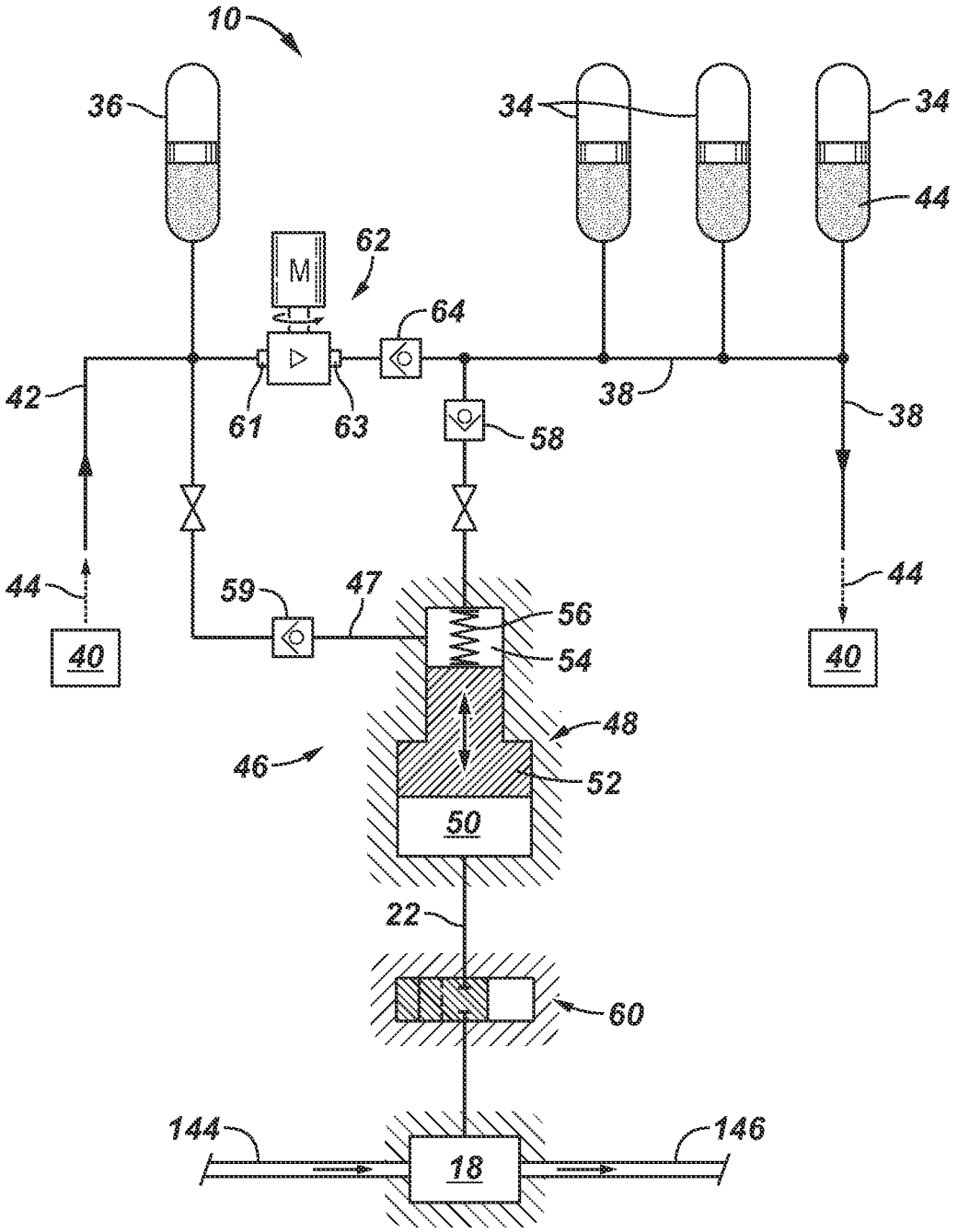
FIG. 5 is a schematic diagram of an example of an in-riser hydraulic power recharging system in accordance to one or more embodiments.

FIG. 5 illustrates an embodiment of in-riser hydraulic power recharging system 10 using a hydraulic recharging circuit 46 as a secondary recharging circuit. For example, with additional reference to FIGS. 1-3, hydraulic power unit 14 may include one or more hydraulic pumps 62 to recharge hydraulic supply accumulators 34. For example, return conduit 42 may be connected to an inlet 61 of a hydraulic pump 62 and the outlet 63 of hydraulic pump 62 is connected to supply conduit 38 for example through a one-way valve 64. Hydraulic pump 62 may be operated to pressurize hydraulic fluid 44 from return conduit 42 and hydraulic reservoir 36 and communicate the pressurized hydraulic fluid 44 to hydraulic supply accumulators 34. In the illustrated embodiment, high pressure side 54 of intensifier 48 is hydraulically connected through reserve one-way valve 59 to return conduit 42 and hydraulic reservoir 36 upstream of inlet 61 to hydraulic pump 62 and high pressure side 54 is hydraulically connected to supply conduit 38 and hydraulic supply accumulators 34 through supply one-way valve 58 downstream of outlet 63 of hydraulic pump 62. In accordance to embodiments, hydraulic recharging circuit 46 can be utilized for example in the same manner as described with reference to FIGS. 1-4 to pressurize one or more of hydraulic supply accumulators 34.

Figure 6:
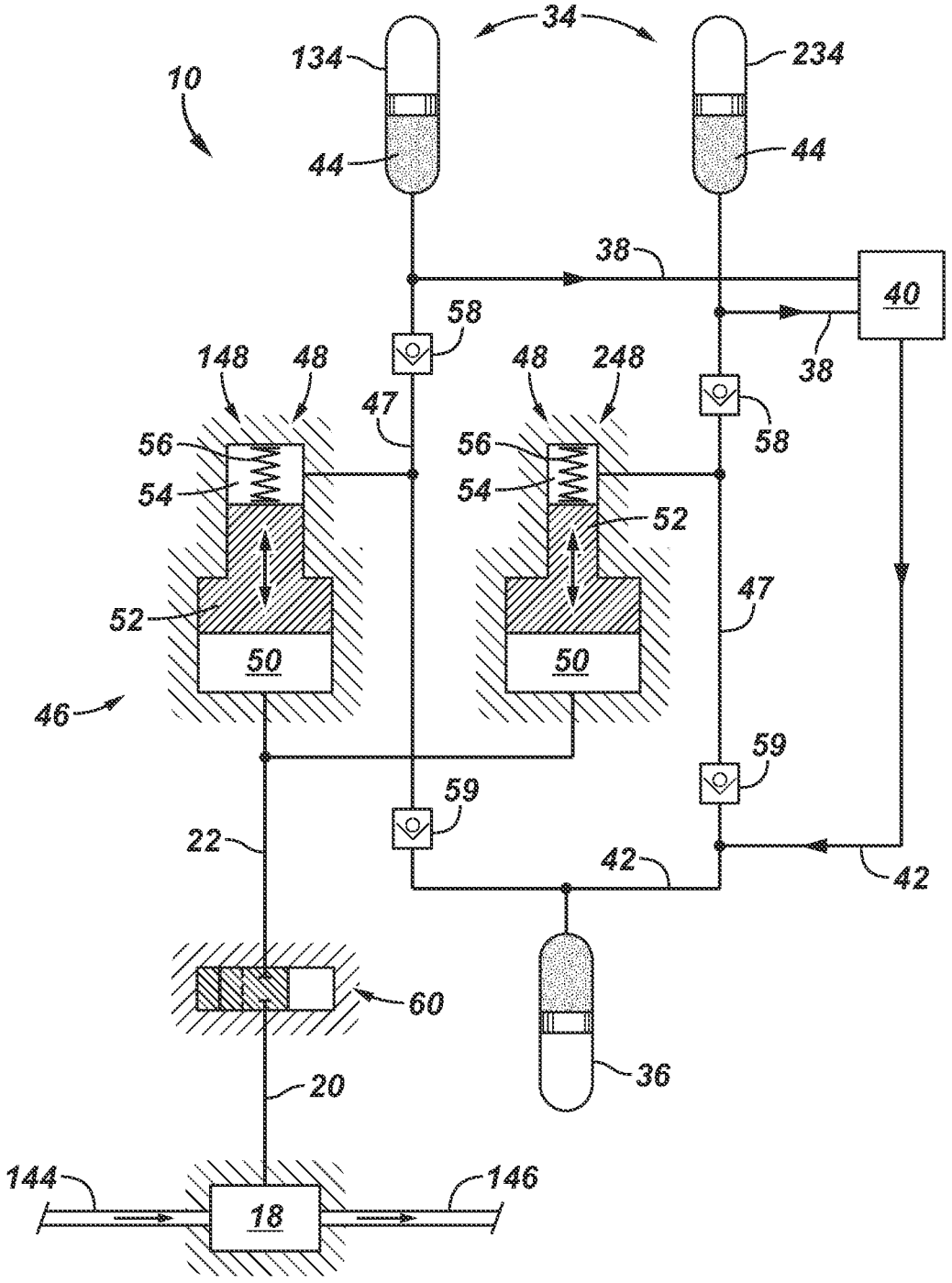
FIG. 6 is a schematic diagram of an example of an in-riser hydraulic power recharging system in accordance to one or more embodiments.

FIG. 6 is a schematic illustration of an in-riser hydraulic power recharging system 10 for pressurizing individual hydraulic supply accumulators 34 to different pressures levels. For example, in the embodiment illustrated in FIG. 6, the left hydraulic supply accumulator 34 is identified specifically as a low pressure accumulator 134 and the right hydraulic supply accumulator 34 is identified specifically as a high pressure accumulator 234. For example, and without limitation, low pressure accumulator 134 may be a 5,000 psi accumulator and high pressure accumulator 234 may be a 10,000 psi accumulator. According to embodiments, hydraulic recharging circuit 46 may comprise a first intensifier 48 identified specifically as low pressure intensifier 148 disposed to hydraulically pressurize (e.g., recharge) low pressure accumulator 134 and a second intensifier 48 identified specifically as high pressure intensifier 248 to pressurize (e.g., recharge) high pressure accumulator 234. For example, low intensifier 148 may be a 5 to 1 intensifier and high pressure intensifier 248 may be a 10 to 1 intensifier. In the illustrated embodiment, low pressure intensifier 148 has a low pressure side 50 in hydraulic communication with annulus pressure zone 18 and high pressure side 54 in hydraulic communication with supply conduit 38 and low pressure accumulator 134 through a supply one-way valve 58 and high pressure side 54 is in hydraulic communication with hydraulic reservoir 36 and return conduit 42 through reserve one-way valve 59. Similarly, high pressure intensifier 248 has a low pressure side 50 in hydraulic communication with annulus pressure zone 18 and high pressure side 54 in hydraulic communication with supply conduit 38 and high pressure accumulator 234 through a supply one-way valve 58 and high pressure side 54 is in hydraulic communication with hydraulic reservoir 36 and return conduit 42 through reserve one-way valve 59. According to embodiments, each of low pressure accumulator 134 and high pressure accumulator 234 can be pressurized (i.e., recharged) in response to the same applied hydraulic pressure at annulus pressure zone 18. For example, applying a hydraulic pressure of 1,000 psi via BOP access line 144 to annulus pressure zone 18 operates hydraulic recharging circuit 46 to pressurize each of low pressure accumulator 148 and high pressure accumulator 248 to the respective desired pressure level. For example, the applied hydraulic pressure is communicated from annulus pressure zone 18 to low pressure side 50 of low pressure intensifier 148 causing hydraulic fluid 44 to be drawn from hydraulic reservoir 36 to high pressure side 54 of low pressure intensifier 148 and communicated at a pressure of 5,000 psi to low pressure accumulator 134 thereby pressurizing low pressure accumulator 134. Similarly, the applied hydraulic pressure is communicated to low pressure side 50 of high pressure intensifier 248 causing hydraulic fluid 44 to be drawn from hydraulic reservoir 36 to high pressure side 54 and communicated at an increased pressure of 10,000 psi to high pressure accumulator 234 thereby pressurizing high pressure accumulator 234.

Figure 7:
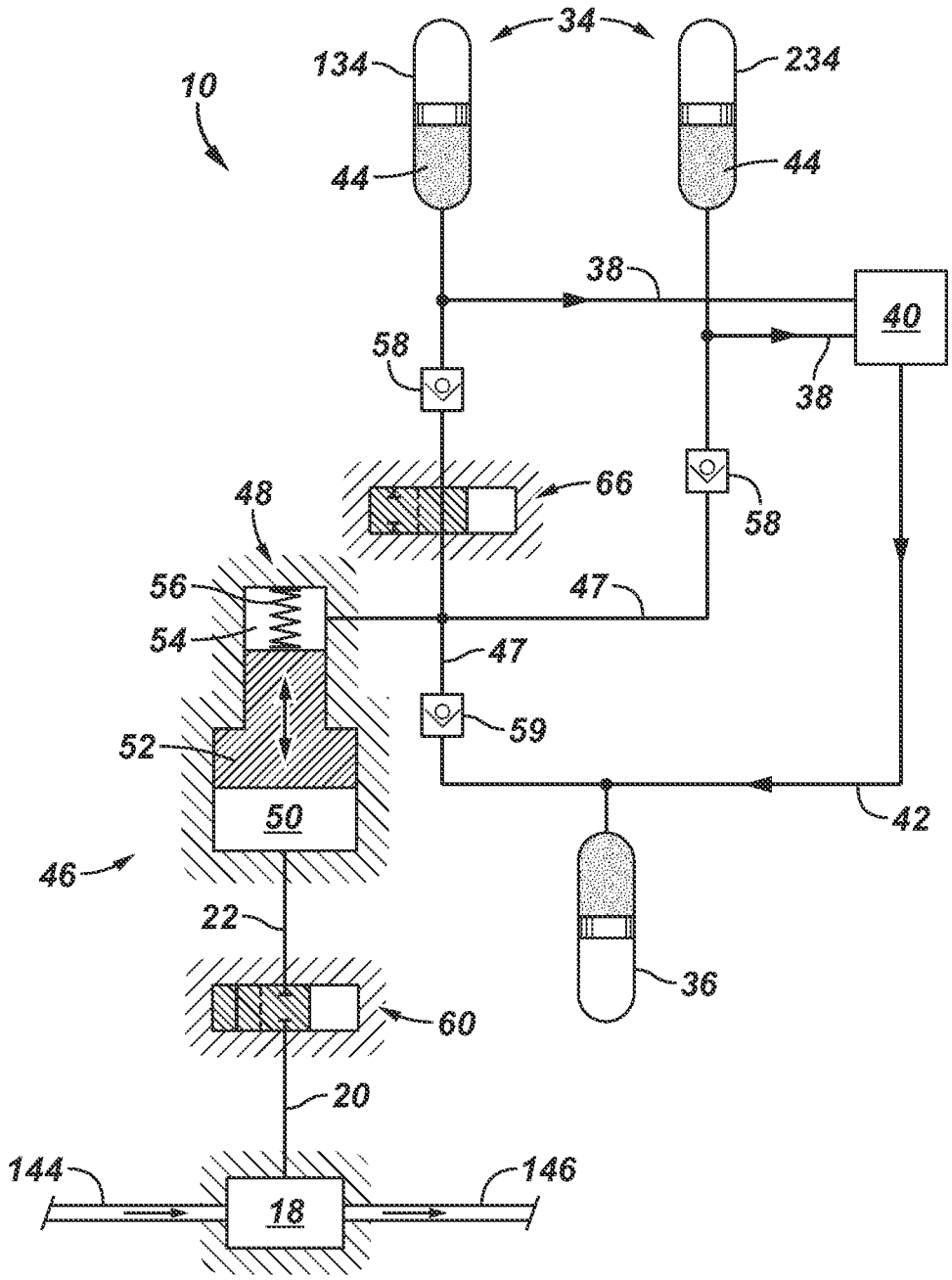
FIG. 7 is a schematic diagram of an example of an in-riser hydraulic power recharging system in accordance to one or more embodiments.

FIG. 7 is a schematic illustration of an embodiment of an in-riser hydraulic power recharging system 10 utilizing a single intensifier 48 to charge individual hydraulic supply accumulators 34 to different pressures. In the illustrated embodiment, the left hydraulic supply accumulator 34 is identified specifically as a low pressure accumulator 134 and the right hydraulic supply accumulator 34 is identified specifically as a high pressure accumulator 234. Low pressure side 50 of intensifier 48 is hydraulically connected to annulus pressure zone 18 for example through valve 60. Low pressure accumulator 134 is hydraulically connected to high pressure side 54 of intensifier 48 through a second valve 66 (e.g., control valve). In this embodiment, second valve 66 is depicted as normally open. High pressure accumulator 234 is hydraulically connected to high pressure side 54 of intensifier 48 bypassing second valve 66. According to a non-limiting embodiment, low pressure accumulator 134 is a 5,000 psi accumulator, high pressure accumulator 234 is a 10,000 psi accumulator, and intensifier 48 is a 5 to 1 intensifier. In accordance with an embodiment, a first hydraulic pressure is applied at pressure zone 18 and communicated to low pressure side 50 and the corresponding high hydraulic pressure fluid 44 from high pressure side 54 is communicated to both low pressure accumulator 134 through open second valve 66 and to high pressure accumulator 234. For example, for a first applied hydraulic pressure of 1,000 psi applied via BOP access line 144 to annulus pressure zone 18 and hydraulic recharging circuit 46 is converted by 5 to 1 intensifier 48 to a 5,000 psi hydraulic pressure at high pressure side 54 and communicated to both of low pressure accumulator 134 and high pressure accumulator 234. Applying the first hydraulic pressure to pressurize low pressure accumulator 134 to the desired pressure level range may include repeating the process of increasing and decreasing the first applied hydraulic pressure. To recharge high pressure accumulator 234 to 10,000 psi, second control valve 66 is closed and a second hydraulic pressure of 2,000 psi is applied through BOP access line 144 to annulus pressure zone 18 and low pressure side 50 of intensifier 48. The 5 to 1 intensifier 48 converts the second applied pressure zone 18 pressure to 10,000 psi and communicates the hydraulic pressure to pressurize high pressure accumulator 234. Once again, applying the second applied pressure may include increasing and decreasing the pressure level in annulus pressure zone 18 multiple times.

Figure 8:
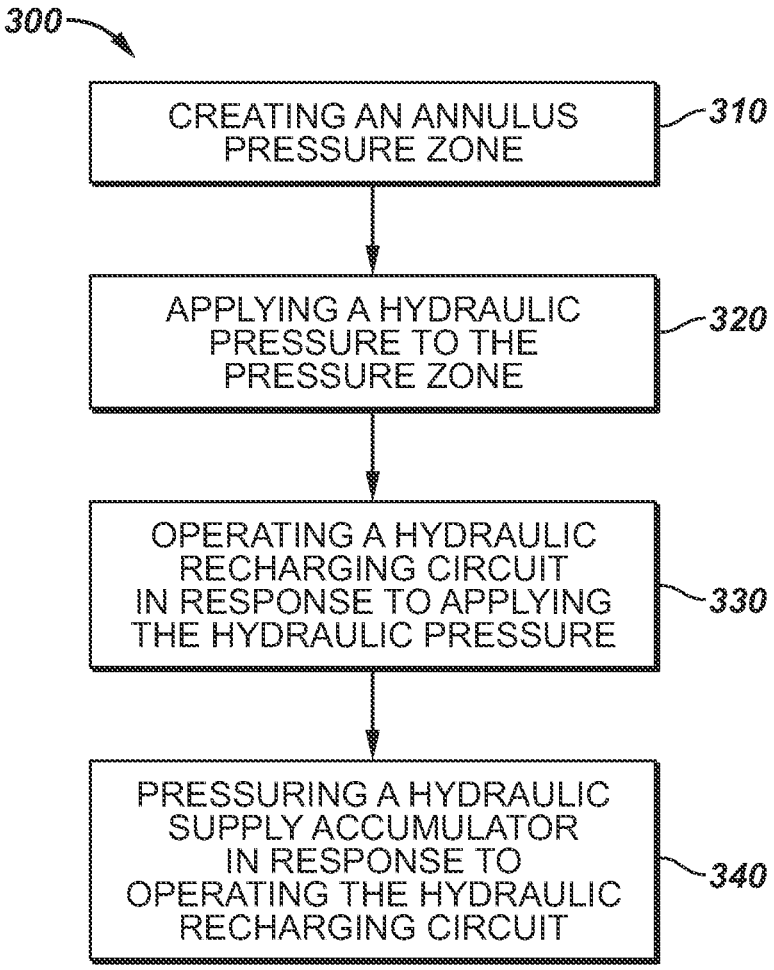
FIG. 8 is a block diagram illustrating an example of an in-riser hydraulic power recharging method in accordance to one or more embodiments.

A non-limiting example of an in-riser hydraulic power recharging method is now described with reference to the block diagram depicted in FIG. 8 and with additional reference to FIGS. 1-7. An in-riser hydraulic power recharging method 300 in accordance to one or more embodiments includes creating 310 an annulus pressure zone 18 in hydraulic communication with a hydraulic supply accumulator 34 through a hydraulic recharging circuit 46. Annulus pressure zone 18 may be created in blowout preventer stack 108, for example by closing a blowout preventer stack ram 138, 142. Non-limiting examples for creating 310 annulus pressure zone 18 are described above, for example with specific reference to FIGS. 2 and 3. Applying 320 hydraulic pressure to annulus pressure zone 18 may be performed for example by communicating drilling fluid 26 through BOP access line 144 to annulus pressure zone 18. Applying 320 hydraulic pressure to annulus pressure may be solely for the purpose of operating hydraulic recharging circuit 46 or to accomplish other tasks. For example, hydraulic pressure may be applied 320 to annulus pressure zone 18 during well testing. According to some embodiments, applying 320 hydraulic pressure includes increasing and decreasing the pressure level (e.g., cycling the pressure) in annulus pressure zone 18. In accordance to one or more embodiments, applying 320 hydraulic pressure may include applying a first pressure level and subsequently applying a second pressure level different from the first pressure level. Depicted method 300 includes operating 330 hydraulic recharging circuit 46 in response to the applied hydraulic pressure. Operating 330 hydraulic recharging circuit 46 includes communicating the applied hydraulic pressure from annulus pressure zone 18 to recharging circuit 46. According to some embodiments, operating 330 may include operating one or more control valves 60, 66 while applying 320 the hydraulic pressure. Pressurizing 340 the closed loop hydraulic control circuit 38, 42, for example hydraulic supply accumulator 34, may include increasing the pressure level of the applied hydraulic pressure level communicated to hydraulic recharging circuit 46 and communicating that increased pressure level to hydraulic fluid 44 in closed loop hydraulic control circuit 38, 42 and hydraulic supply accumulator 34. Pressuring 340 may include pressurizing first hydraulic supply accumulator, for example a low pressure accumulator 134, to a first pressure level and pressuring a second hydraulic supply accumulator, for example a high pressure accumulator 234, to a second pressure level higher than the first pressure level. In accordance to some embodiments, the low pressure hydraulic supply accumulator 134 and the high pressure hydraulic supply accumulator 234 may be pressurized 340 substantially simultaneously while applying 320 the hydraulic pressure at a first level.

Although only a few example embodiments have been described in detail above, those skilled in the art will readily appreciate that many modifications are possible in the example embodiments without materially departing from the invention. Accordingly, all such modifications are intended to be included within the scope of this disclosure as defined in the following claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas the screw employs a helical surface, in the environment unfastening wooden parts, a nail and a screw may be equivalent structures. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A method for pressurizing a hydraulic accumulator, comprising:

creating an annulus pressure zone by closing rams in a blowout preventer stack, said annulus pressure zone being in hydraulic communication with a hydraulic accumulator through a hydraulic recharging circuit, the hydraulic recharging circuit having a hydraulic intensifier in communication with a hydraulic reservoir and with a hydraulically actuated device;

applying a hydraulic pressure to the annulus pressure zone;

operating the hydraulic recharging circuit via shifting of the hydraulic intensifier in response to the applied hydraulic pressure;

pressurizing the hydraulic accumulator in response to the operating the hydraulic recharging circuit; and shifting the hydraulic intensifier back toward an original position to draw hydraulic fluid from the hydraulic reservoir.

2. The method of claim 1, wherein the annulus pressure zone is created in the blowout preventer stack.

3. The method of claim 1, wherein the annulus pressure zone is between a tubing hanger and a closed pipe ram.

4. The method of claim 1, wherein the applying the hydraulic pressure to the annulus pressure zone comprises increasing pressure in the annulus pressure zone and decreasing pressure in the annulus pressure zone.

5. The method of claim 1, wherein the hydraulic pressure applied to the annulus pressure zone is communicated through a blowout preventer access line.

6. The method of claim 1, wherein:

the hydraulic accumulator comprises a first hydraulic accumulator and a second hydraulic accumulator; and the pressurizing the hydraulic accumulator comprises pressurizing the first hydraulic accumulator to a first pressure and pressurizing the second hydraulic accumulator to a second pressure different from the first pressure.

7. The method of claim 6, wherein the hydraulic intensifier of the hydraulic recharging circuit comprises:

a first intensifier hydraulically connected between the annulus pressure zone and the first hydraulic accumulator; and a second intensifier hydraulically connected between the annulus pressure zone and the second hydraulic accumulator.

* * * * *